US007352982B2

(12) United States Patent
Mori

(10) Patent No.: US 7,352,982 B2
(45) Date of Patent: Apr. 1, 2008

(54) DEVELOPER REMOVAL METHOD AND DEVELOPER REMOVAL DEVICE

(75) Inventor: Hiroki Mori, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 225 days.

(21) Appl. No.: 10/943,985

(22) Filed: Sep. 20, 2004

(65) Prior Publication Data

US 2005/0069341 A1 Mar. 31, 2005

(30) Foreign Application Priority Data

Sep. 30, 2003 (JP) ..... 2003-339765

(51) Int. Cl.
*G03G 15/00* (2006.01)

(52) U.S. Cl. ..... 399/109

(58) Field of Classification Search ..... 399/109.12, 399/358–360
See application file for complete search history.

(56) References Cited

U.S. PATENT DOCUMENTS

| | | | | |
|---|---|---|---|---|
| 4,945,956 | A | 8/1990 | Bueyuekgueclue et al. | |
| 5,074,342 | A * | 12/1991 | Kraehn | 141/65 |
| 2002/0088138 | A1 | 7/2002 | Murakami et al. | |

FOREIGN PATENT DOCUMENTS

| | | |
|---|---|---|
| JP | A 7-84444 | 3/1995 |
| JP | A 2000-293080 | 10/2000 |
| JP | A 2001-235996 | 8/2001 |
| JP | A 2002-202704 | 7/2002 |
| JP | A 2002-207365 | 7/2002 |

* cited by examiner

*Primary Examiner*—David M. Gray
*Assistant Examiner*—Ryan Gleitz
(74) *Attorney, Agent, or Firm*—Oliff & Berridge, PLC

(57) ABSTRACT

A developing cartridge is placed on a supporting member such that a lengthwise direction of the developing cartridge is inclined with respect to the vertical and horizontal directions, collecting toner remaining in the developing cartridge at the lowest part in the developing cartridge. Then, a suction tube is inserted into a toner chamber of the developing cartridge and sucks up toner remaining in the developing cartridge.

20 Claims, 9 Drawing Sheets

24

DEVELOPER REMOVAL METHOD AND DEVELOPER REMOVAL DEVICE

BACKGROUND OF THE INVENTION

1. Field of the Invention

The present invention relates to a developer removal method and a developer removal device for removing developer remaining inside a used developing device in order to reuse the developing device.

2. Related Art

Conventionally, a developing unit filled with toner is installed in a freely insertable and removable manner in an electrophotographic image forming device, such as a laser printer.

This kind of developing unit is divided into a toner chamber and a developing chamber. The toner chamber is filled with toner and provided with an agitator. The developing chamber is provided with a supply roller, a developing roller disposed in opposition to the supply roller, and a thickness regulation blade pressed against the surface of the developing roller.

When motive power from the laser printer is input to the developing unit by a gear train or the like, toner in the toner chamber is transported to the developing chamber by rotation of the agitator. The toner transported into the developing chamber is then supplied to the developing roller by rotation of the supply roller. At this time, the toner is triboelectrically charged between the supply roller and the developing roller. Also, as the developing roller rotates, toner supplied to the surface of the developing roller comes between the thickness regulation blade and the developing roller, and is held on the surface of the developing roller as a thin layer of uniform thickness.

The developing unit is installed into the laser printer such that the developing roller is located in confrontation with a photosensitive drum. When toner held as a thin layer on the surface of the developing roller comes into opposition to the photosensitive drum, the toner forms a toner image by developing an electrostatic latent image formed on the surface of the photosensitive drum. Thereafter, the toner image is transferred onto a paper sheet by a transfer roller.

The toner in the toner chamber is consumed in this manner. When no toner is left, the laser printer gives an "out of toner" indication prompting the user to replace the developing unit. The user therefore removes the used developing unit and installs a new developing unit.

In recent years, however, from a recycling standpoint, it has become common for used developing units not to be discarded but to be refilled with toner and reused.

When refilling a used developing unit with new toner, it is necessary to remove toner remaining inside the used developing unit to such an extent that the residual toner does not affect the insertion and use of the new toner.

Japanese Patent Application-Publication No. HEI-7-84444 proposes a method of removing such residual toner. In this method, a developing unit is supported with its developing sleeve facing upward by a movable supporting stand placed in a standby position. Then, the supporting stand is moved to an operational position, and a sleeve gear of the developing sleeve is engaged with a drive gear. A suction aperture at the end of a suction nozzle is inserted in a toner chamber, and the residual toner in the toner chamber is sucked up by the suction nozzle while the developing sleeve is driven to rotate by a motor.

SUMMARY OF THE INVENTION

However, in this method, the developing unit is supported horizontally by the supporting stand, and therefore the residual toner is widely distributed horizontally inside the developing unit. As a result, it is difficult to thoroughly and efficiently suck up the widely-distributed residual toner by inserting the suction nozzle into the developing unit and applying suction force.

In the view of foregoing, it is an object of the present invention to overcome the above problems and also to provide a developer removal method and a developer removal device for thoroughly and efficiently remove residual developer from a developing device.

In order to attain the above and other objects, according to one aspect of the present invention, there is provided a developer removal method for removing developer remaining inside a developing device. The developer removal method includes placing the developing device such that a lengthwise direction of the developing device is inclined with respect to a vertical direction and a horizontal direction, inserting a suction device into the developing device, and sucking the developer remaining in the developing device by the suction device.

According to a different aspect of the present invention, there is provided a developer removal method for removing developer remaining inside a developing device provided with a developer bearing body. The developer removal method includes placing the developing device such that a lengthwise direction of the developer bearing body is inclined with respect to a vertical direction and a horizontal direction, inserting a suction device into the developing device, and sucking the developer remaining in the developing device by the suction device.

According to a different aspect of the present invention, there is provided a developer removal device including a support that supports a developing device such that a longitudinal direction of the developing device is inclined with respect to a vertical direction and a horizontal direction.

According to a still different aspect of the present invention, there is provided a developer removal device including a support that supports a developing device such that a longitudinal direction of a developer bearing body of the developing device is inclined with respect to a vertical direction and a horizontal direction.

BRIEF DESCRIPTION OF THE DRAWINGS

In the drawings:

FIG. 5(*b*) is an enlarged partial view of the suction member of FIG. 5(*a*);

FIG. 5(*c*) is a cross-sectional view of the suction member taken along an A-A line of FIG. FIG. 5(*a*);

PREFERRED EMBODIMENT OF THE PRESENT INVENTION

Next, a toner removal method and a toner removal device according to an embodiment of the present invention will be described with reference to the accompanying drawings.

Figure 1:
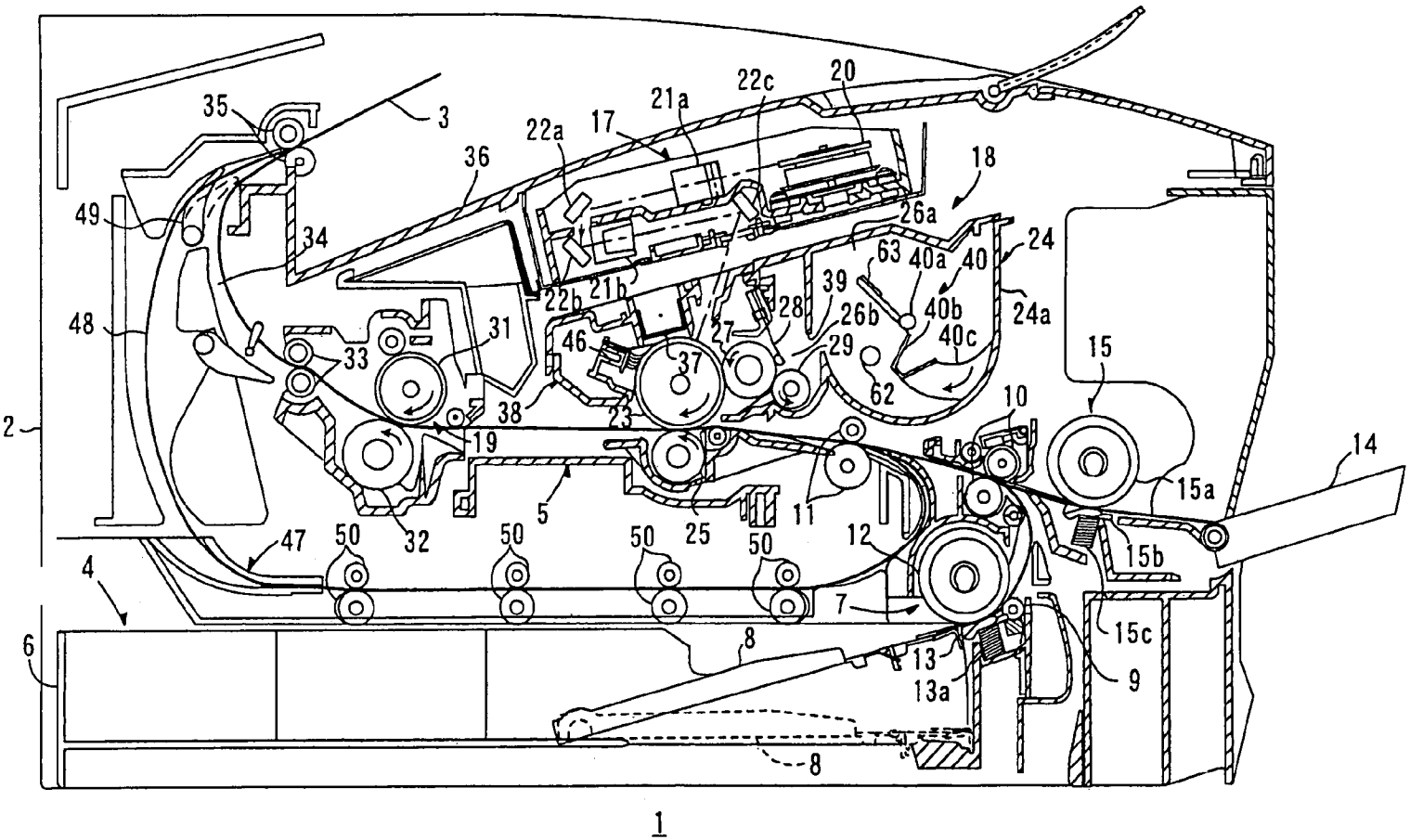
FIG. 1 is a cross-sectional side view of a laser printer according to an embodiment of the present invention.

A laser printer 1 shown in FIG. 1 is an electrophotographic image forming device according to the present embodiment. As shown in FIG. 1, the laser printer 1 includes a main casing 2, a feeder unit 4, and an image-forming unit 5. The main casing 2 houses the feeder unit 4 and the image-forming unit 5. The feeder unit 4 is for feeding recording sheets 3, and the image-forming unit 5 is for forming prescribed images on the recording sheet 3.

The feeder unit 4 includes a sheet supply tray 6, a sheet supply mechanism 7, a sheet pressing plate 8, paper dust removing rollers 9, 10, and registration rollers 11. The sheet supply tray 6 is detachably mounted at the bottom section of the main casing 2. The sheet supply mechanism 7 is disposed at one end of the sheet supply tray 6. The sheet pressing plate 8 is disposed inside the sheet supply tray 6. The paper dust removing rollers 9, 10 are disposed downstream of a sheet feed direction in which the recording sheets 3 are conveyed (hereinafter, upstream or downstream with respect to the sheet feed direction will be abbreviated simply to "upstream" or "downstream"). The registration rollers 11 are disposed downstream of the paper dust removing rollers 9, 10 with respect to the sheet feed direction.

The paper supply tray 6 has an open-top box shape capable of accommodating a stack of recording sheets 3 and can be inserted into and removed from the bottom section of the main casing 2 horizontally.

The sheet supply mechanism 7 has a supply roller 12 and a separation pad 13 opposite the supply roller 12. A spring 13*a* is located on the rear side of the separation pad 13 and presses the separation pad 13 against the supply roller 12.

The sheet pressing plate 8 is capable of supporting a stack of sheets 3. The sheet pressing plate 8 is pivotably supported at its end furthest from the supply roller 12 so that the end of the sheet pressing plate 8 that is nearest the supply roller 12 can move upward and downward. Although not shown in the drawings, a spring for urging the sheet pressing plate 8 upward is provided to the rear surface of the sheet pressing plate 8. Therefore, the sheet pressing plate 8 pivots downward around the end of the sheet pressing plate 8 farthest from the sheet supply mechanism 7 in accordance with increase in the amount of sheets 3 stacked on the sheet pressing plate 8, against the urging force of the spring. Urging force of the spring under the sheet pressing plate 8 presses the uppermost sheet 3 on the sheet pressing plate 8 toward the supply roller 12 so that rotation of the supply roller 12 moves the uppermost sheet 3 between the supply roller 12 and the separation pad 13. In this way, the supply roller 12 separates one sheet 3 at a time from the stack and supplies the same to the paper dust removing rollers 9, 10 in cooperation with the separation pad 13. The paper dust removing rollers 9, 10 remove paper dust from the sheet 3, and then the sheet 3 is conveyed to the registration rollers 11.

The registration rollers 11 perform a desired registration operation on the supplied sheets 3 and transports the same to an image formation position where a photosensitive drum 23 and a transfer roller 25 contact each other. In other words, the image formation position is a transfer position where a visible toner image is transferred from the surface of the photosensitive drum 23 to a sheet 3.

The feeder unit 4 further includes a multipurpose tray 14 in which a stack of paper sheets 3 of an arbitrary size is mounted and a multipurpose paper feed mechanism 15 for feeding the paper sheets 3 stacked in the multipurpose tray 14.

The multipurpose paper feed mechanism 15 has a multipurpose paper feed roller 15*a* and a multipurpose separation pad 15*b* opposite the multipurpose paper feed roller 15*a*. A spring 15*c* is located on the rear side of the multipurpose separation pad 15*b*, and the multipurpose separation pad 15*b* is pressed against the multipurpose paper feed roller 15*a* by the urging force of the spring 15*c*.

The topmost sheet 3 of the stack in the multipurpose tray 14 is taken up between the multipurpose paper feed roller 15*a* and the multipurpose separation pad 15*b* by the rotation of the multipurpose paper feed roller 15*a*, and is separated and fed one at a time toward the registration rollers 11 by the cooperative action of these two.

The image forming unit 5 includes a scanner section 17, a process unit 18, and a fixing section 19.

The scanner section 17 is provided at the upper section of the main casing 2 and is provided with a laser emitting section (not shown), a rotatingly driven polygon mirror 20, lenses 21*a*, 21*b*, and reflection mirrors 22*a*, 22*b*, 22*c*. The laser emitting section emits a laser beam based on desired image data. As indicated by single-dot chain line in FIG. 1, the laser beam passes through or is reflected by the mirror 20, the lens 21*a*, the reflection mirrors 22*a* and 22*b*, the lens 21*b*, and the reflection mirror 22*c* in this order so as to irradiate, in a high speed scanning operation, the surface of the photosensitive drum 23 of the process unit 18.

The process unit 18 is disposed below the scanner section 17. The process unit 18 includes a drum cartridge 38 detachably mounted in the main casing 2. The drum cartridge 38 houses the photosensitive drum 23, a developing cartridge 24, a transfer roller 25, a scorotron charger 37, and a cleaning brush 46.

The developing cartridge 24 is detachably mounted in the drum cartridge 38. The developing cartridge 24 can be inserted into or removed from the drum cartridge 38 both when the drum cartridge 38 has been removed from the main casing 2 and when the drum cartridge 38 is installed therein.

Figure 2:
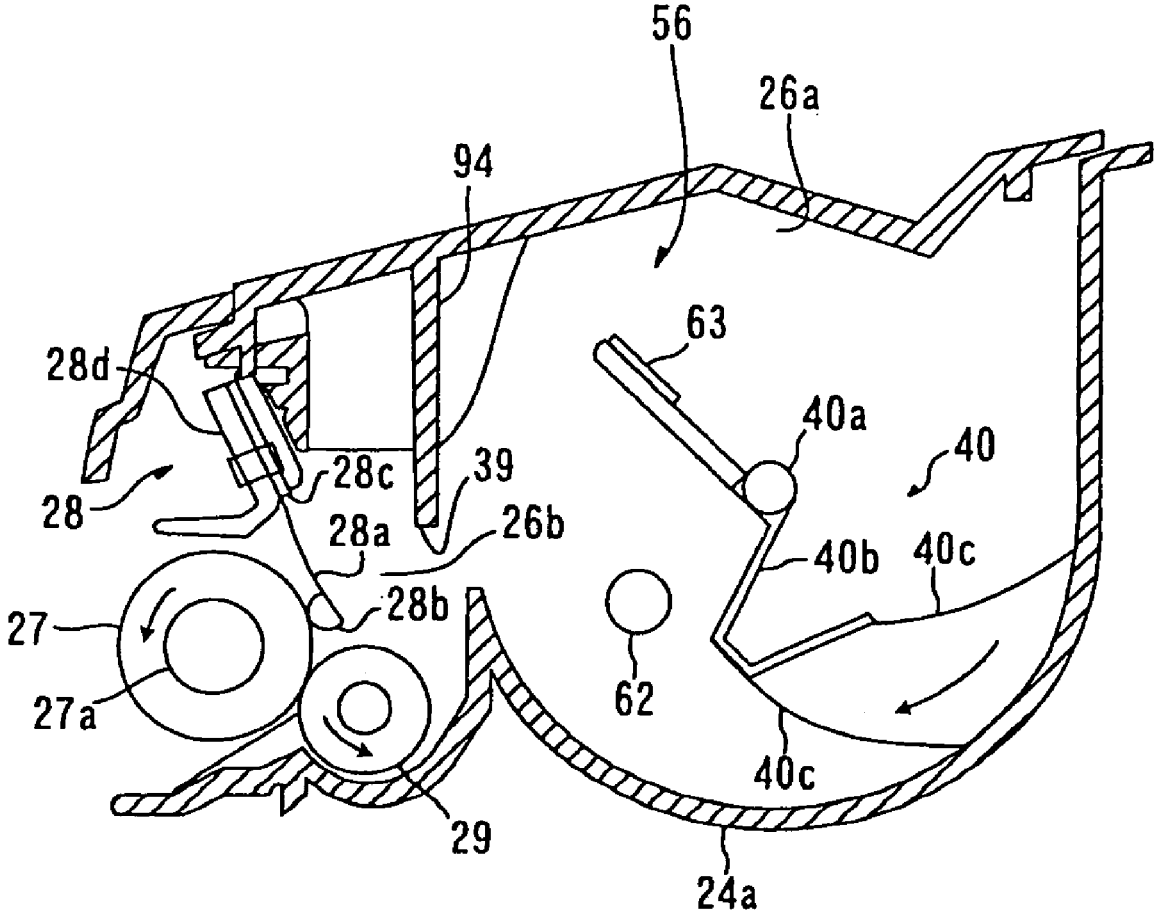
FIG. 2 is a cross-sectional side view of a developing cartridge of the laser printer shown in FIG. 1.
Figure 8:
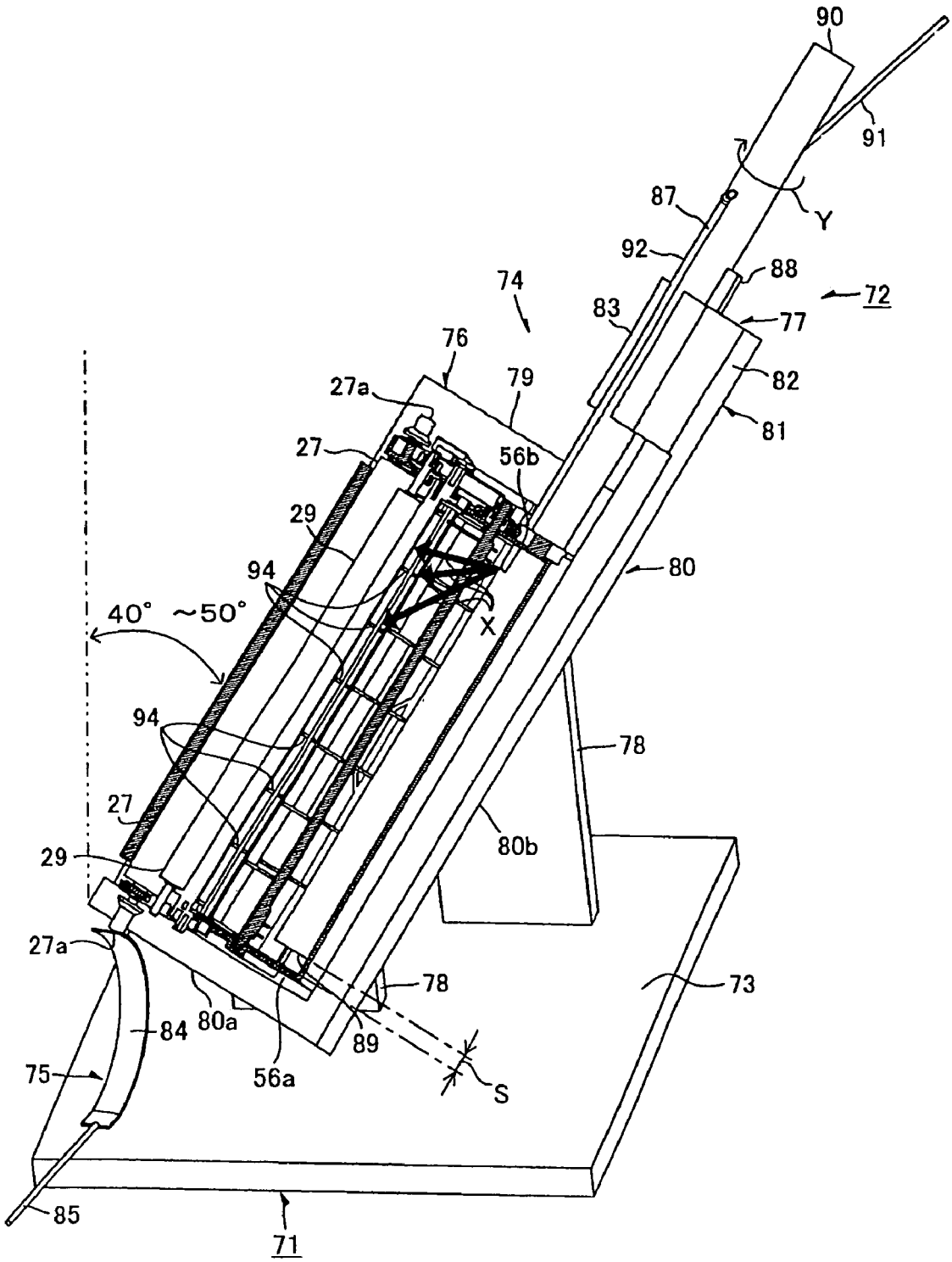
FIG. 8 is an explanatory view of a toner removal method according to the embodiment of the present invention.

As shown in FIG. 2, inside a casing 24*a* of the developing cartridge 24 is divided into a toner chamber 26*a* and a developing chamber 26*b* as separate compartments while being reinforced by a plurality of inner ribs 94 (only one of the inner ribs 94 is shown in FIG. 2). Toner supply apertures 39 are formed between the inner ribs 94 and the casing 24*a*. The plurality of inner ribs 94 are arranged in a lengthwise direction of the casing 24*a* as shown in FIG. 8.

As shown in FIG. 2, an agitator 40 is rotatably disposed inside the toner chamber 26*a*, and the toner chamber 26*a* is filled with positively charging, non-magnetic, single-component toner.

In this embodiment, polymerization toner is used as the toner. To produce polymerization toner, a polymerizing monomer is dissolved or dispersed in a polymerization medium together with a polymerization starting agent, a colorant such as carbon black, and as necessary, a cross-linking agent, charge control agent, and other additives.

Then, the resultant mixture is subjected to a suspension polymerization by stirring and dispersing the mixture during the aqueous phase. Examples of a polymerizing monomer include a styrene type monomer or an acrylic type monomer. An example of a styrene type monomer is styrene. Examples of acrylic type monomers are acrylic acid, acrylic (C1-C4) acrylate, and acrylic (C1-C4) metaacrylate. The polymerization toner has roughly spherical grains with an average diameter of approximately 6 to 10 μm, and has extremely good fluidity. A colorant such as carbon black, wax, and so forth, are mixed with this polymerization toner. Also, an external additive, such as silica, titanium oxide, aluminum oxide, or the like, is added to the toner base particles in order to improve the fluidity of the toner.

The agitator 40 has a rotating shaft 40*a*, an agitation blade 40*b*, and a film member 40*c*. The rotating shaft 40*a* is rotatably supported in the center of the toner chamber 26*a*. The agitation blade 40*b* is fitted around the rotating shaft 40*a*, and the film member 40*c* is affixed to a free end of the agitation blade 40*b*. The rotating shaft 40*a* is driven to rotate by motive power from a gear mechanism section (not shown) together with the agitation blade 40*b*. Through the rotation of the agitation blade 40*b*, the film member 40*c* scrapes up and transports the toner inside the toner chamber 26*a* into the developing chamber 26*b*. A cleaner 63 for cleaning windows 62 (described later) is fitted to the rotating shaft 40*a* on the opposite side to the agitation blade 40*b*.

A developing roller 27, a thickness regulation blade 28, and a supply roller 29 are disposed inside the developing chamber 26*b*.

The supply roller 29 is disposed below the toner supply apertures 39 so as to be rotatable in a direction indicated by an arrow (counterclockwise direction in FIG. 2). The supply roller 29 has a metal roller shaft covered by a roller made of an electrically conductive sponge material.

The developing roller 27 is disposed to the side of the supply roller 29 so as to be rotatable in a direction indicated by an arrow (counterclockwise direction in FIG. 2). The developing roller 27 includes a metal roller shaft 27*a* covered by a roller that is formed of an electrically conductive resilient material. More specifically, the roller of the developing roller 27 is formed of an electrically conductive urethane rubber or silicon rubber including fine carbon particles, the surface of which is coated with a urethane rubber or silicon rubber including fluorine. A developing bias is applied to the developing roller 27 with respect to the photosensitive drum 23.

The supply roller 29 and the developing roller 27 are positioned opposite each other and in mutual contact so that each is compressed to a certain degree.

The thickness regulation blade 28 is positioned above the developing roller 27 and opposed along the axial direction of the developing roller 27 at a position near the developing roller 27.

The thickness regulation blade 28 has a leaf spring 28*a*, a pressing part 28*b*, a backup member 28*c*, and a supporting member 28*d*. The pressing part 28*b* is made of insulative silicone rubber to have a semicircular cross-section and contacts the developing roller 27. The backup member 28*c* is provided on the rear surface of the leaf spring 28*a*. The supporting member 28*d* is for supporting the rear end of the leaf spring 28*a* in the casing 24*a* of the developing cartridge 24. With the leaf spring 28*a* supported in the casing 24*a* by the supporting member 28*d*, the pressing part 28*b* is pressed against the surface of the developing roller 27 by the elastic force of the leaf spring 28*a* pressed by the backup member 28*c*.

Figure 3:
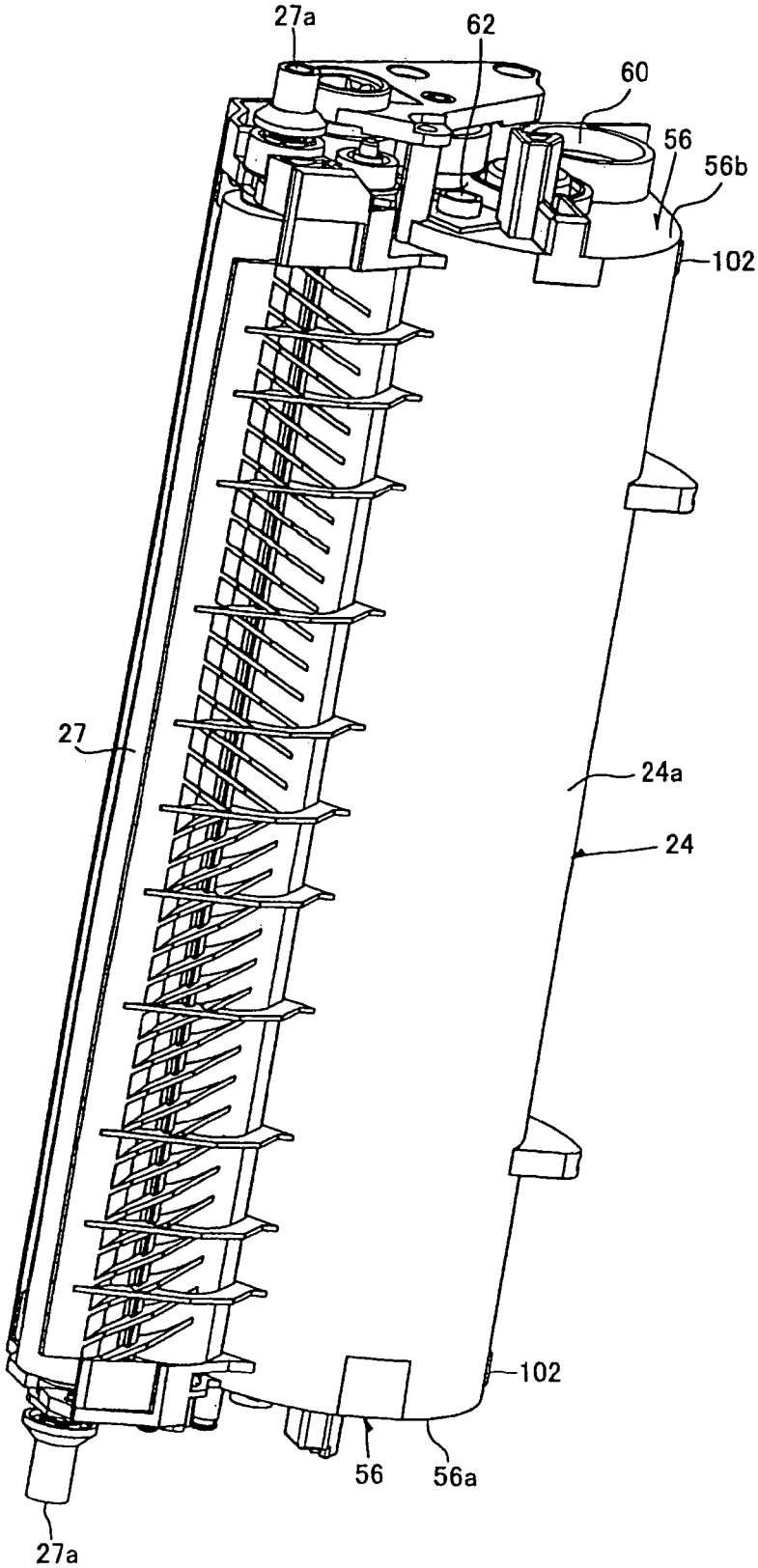
FIG. 3 is a perspective view of the developing cartridge shown in FIG. 2.

As shown in FIG. 3, outer ribs 102 are provided to the casing 24*a* at both ends of a longitudinal side opposite to the side on which a developing roller 27 is provided. The outer ribs 102 fit into positioning grooves 101 described later.

As shown in FIGS. 2 and 3, the side of the casing 24*a* on which the developing roller 27 is disposed is open, and both axial ends of the roller shaft 27*a* of the developing roller 27 are rotatably supported in end walls 56 (56*a*, 56*b*) of the casing 24*a*.

A gear mechanism (not shown) is provided on one end wall 56*a*. When motive power from a motor (not shown) is input to the gear mechanism, the developing roller 27, the supply roller 29, and the agitator 40 are rotated. The other end wall 56*b* is formed with an aperture 60 whereby the toner chamber 26*a* can be opened and closed by a toner cap (not shown).

The aperture 60 is used for inserting a suction member 72 (FIG. 5(*a*)) in order to suck up toner remaining inside the developing cartridge 24 from the toner chamber 26*a* as will be described later.

With this configuration, the toner inside the toner chamber 26*a* is scraped up and transported through the toner supply apertures 39 to the developing chamber 26*b* by the rotation of the agitator 40 in the direction indicated by the arrow. The end walls 56 of the toner chamber 26*a* are formed with the windows 62 for passing light to a photosensor (not shown). As mentioned above, the windows 62 are cleaned by the cleaner 63. The windows 62 are used when detecting the remaining amount of toner. That is, when the toner chamber 26*a* is full of toner, the light does not pass through the toner chamber 26*a*. On the other hand, when the amount of toner remaining in the toner chamber 26*a* becomes low, the light passes through the toner chamber 26*a* and the windows 62. As a result, and an "out of toner" indication is displayed on an operation panel (not shown) disposed on the main casing 2.

The toner transported into the developing chamber 26*b* through the toner supply apertures 39 is supplied to the developing roller 27 by the rotation of the supply roller 29. At this time, the toner is positively tribocharged between the supply roller 29 and the developing roller 27. Further, the toner supplied onto the developing roller 27 is carried between the pressing part 28*b* of the thickness regulation blade 28 and the developing roller 27 with the rotation of the developing roller 27, forming a thin layer of toner having a uniform thickness on the developing roller 27.

As shown in FIG. 1, the photosensitive drum 23 is supported to the side of the developing roller 27 and in confrontation with the developing roller 27 so as to be rotatable in a direction indicated by an arrow (clockwise direction in FIG. 1). The photosensitive drum 23 is formed of a main drum that is grounded. The surface of the main drum is a positively charging photosensitive layer formed of polycarbonate or the like.

The scorotoron charger 37 is disposed above the photosensitive drum 23 and is spaced away from the photosensitive drum 23 by a predetermined space so as to avoid direct contact with the photosensitive drum 23. The scorotron charger 37 is a positive-charge scorotron type charge unit for generating a corona discharge from a tungsten charge wire, for example, to uniformly charge the surface of the photosensitive drum 23 to a positive charge.

The cleaning brush 46 is disposed opposite and in contact with the photosensitive drum 23 at a position downstream of the image formation position, at which the photosensitive drum 23 contacts the transfer roller 25, and upstream of the scorotron charger 37 in the rotating direction of the photosensitive drum 23.

As the photosensitive drum 23 rotates, the scorotron charger 37 forms a uniform positive charge over the surface of the rotating photosensitive drum 23. Subsequently, the surface of the photosensitive drum 23 is exposed by the high-scanning of the laser beam emitted from the scanner section 17 based on image data. As a result, electrostatic latent images are formed on the surface of the photosensitive drum 23.

When the positively charged toner carried on the surface of the developing roller 27 opposes and contacts the photosensitive drum 23 as the developing roller 27 rotates, the toner is selectively supplied to the electrostatic latent image on the photosensitive drum 23, i.e., to areas of the surface of the uniformly charged photosensitive drum 23 that were exposed to the laser beam and, therefore, have a lower potential than the rest of the surface. As a result, the electrostatic latent images on the photosensitive drum 23 are transformed into visible toner images. In this way, a reverse development is performed.

The transfer roller 25 is rotatably supported in the drum cartridge 38 at a position below and in confrontation with the photosensitive drum 23. The transfer roller 25 includes a metal roller shaft and a roller portion covering the roller shaft. The roller portion is made from electrically-conductive rubber material. At the time of toner image transfer, the transfer roller 25 is applied with a predetermined transfer bias with respect to the photosensitive drum 23.

The toner image carried on the surface of the photosensitive drum 23 is transferred to the recording sheet 3 as the recording sheet 3 passes between the photosensitive drum 23 and the transfer roller 25. The recording sheet 3 with the toner image transferred thereon is conveyed to the fixing section 19.

Residual toner remaining on the photosensitive drum 23 after the image transfer is cleaned off by the cleaning brush 46.

The fixing section 19 is disposed to the side of and downstream from the process unit 18 in the sheet feed direction. The fixing section 19 includes a heat roller 31, a pressing roller 32, and conveying rollers 33. The pressing roller 32 presses against the heat roller 31, and the conveying rollers 33 are disposed downstream of the heat roller 31 and the pressing roller 32.

The heat roller 31 is made of metal and has a halogen lamp for heating. A toner image transferred onto a recording sheet 3 is thermally-fixed to the recording sheet 3 while the recording sheet 3 passes between the heat roller 31 and the pressing roller 32. Thereafter, the recording sheet 3 is transported to a discharge path 34 by the conveying rollers 33. After being transported to the discharge path 34, the recording sheet 3 is discharged onto a discharge tray 36 by discharge rollers 35.

The laser printer 1 further includes a reverse conveying unit 47 for enabling a duplex printing to print images on both sides of the sheet 3. The reverse conveying unit 47 includes the discharge rollers 35, a reverse conveying path 48, a flapper 49, and a plurality of reverse conveying rollers 50.

The reverse conveying rollers 50 are disposed below the transfer position. The reverse conveying path 48 extends vertically between the discharge rollers 35 and the reverse conveying rollers 50. The upstream end of the reverse conveying path 48 is located near the discharge rollers 35 and the downstream end is located near the reverse conveying rollers 50 so that sheets 3 can be transported downward from the discharge rollers 35 to the reverse conveying rollers 50.

The flapper 49 is pivotably provided at a branch point between the discharge path 34 and the reverse conveying path 48. By toggling the excitation of a solenoid (not shown) ON and OFF, the conveying direction of the recording sheet 3 reversed by the discharge rollers 35 can be switched from the direction toward the discharge path 34 to the direction toward the reverse conveying path 48.

The reverse conveying rollers 50 are disposed in a substantially horizontal direction above the discharge tray 6. The reverse conveying rollers 50 farthest upstream are positioned near the downstream end of the reverse conveying path 48. The reverse conveying rollers 50 farthest downstream are positioned below the registration rollers 11.

When forming images on both sides of the recording sheet 3, the reverse conveying unit 47 is operated as follows. After having an image formed on one surface, the recording sheet 3 is conveyed by the conveying rollers 33 to the discharge rollers 35 via the discharge path 34. With the recording sheet 3 interposed between the discharge rollers 35, the discharge rollers 35 rotate in a forward rotation, conveying the recording sheet 3 temporarily outward (toward the discharge tray 36), such that a large part of the recording sheet 3 is fed out of the main casing 2. When the trailing edge of the recording sheet 3 becomes interposed between the discharge rollers 35, the discharge rollers 35 halt their forward rotation. Next, the discharge rollers 35 rotate in the reverse direction, and also the flapper 49 switches the conveying direction to convey the recording sheet 3 toward the reverse conveying path 48. Hence, the recording sheet 3 is conveyed toward the reverse conveying path 48 leading now with the trailing edge. After the recording sheet 3 is conveyed into the reverse conveying path 48, the flapper 49 is switched to its original state, that is, the position for conveying the recording sheet 3 supplied from the conveying rollers 33 toward the discharge rollers 35. Next, the recording sheet 3 conveyed along the reverse conveying path 48 in the reverse direction is conveyed to the reverse conveying rollers 50, which in turn convey the recording sheet 3 upward to the registration rollers 11. The registration rollers 11 adjust the recording sheet 3 to a proper register and convey the same toward the image formation position with its upper front and back surfaces switched, enabling images to be formed on both sides of the recording sheet 3.

Then, the recording sheet 3 with images formed on both sides is transported to the fixing section 19 where the images are thermally fixed to the sheet 3, and is discharged onto the discharge tray 36.

With this laser printer 1, when an "out of toner" indication is given, the developing cartridge 24 with little remaining toner is removed, and another developing cartridge 24 full of toner is inserted. The removed developing cartridge 24 whose toner has been used up is not discarded, but is refilled with toner and reused. "Reused" means being used for developing again after having once been used for developing.

In order to reuse a used developing cartridge 24, it is necessary to remove toner remaining inside the toner chamber 26*a* of the used developing cartridge 24 to such an extent that remaining toner does not affect the insertion and use of new toner (for example, leaving no more than 14 g of residual toner in the case of a developing cartridge that contains 190 g of toner when full).

Next, a method of removing toner remaining in a used developing cartridge 24 will be described in detail.

Figure 5A:
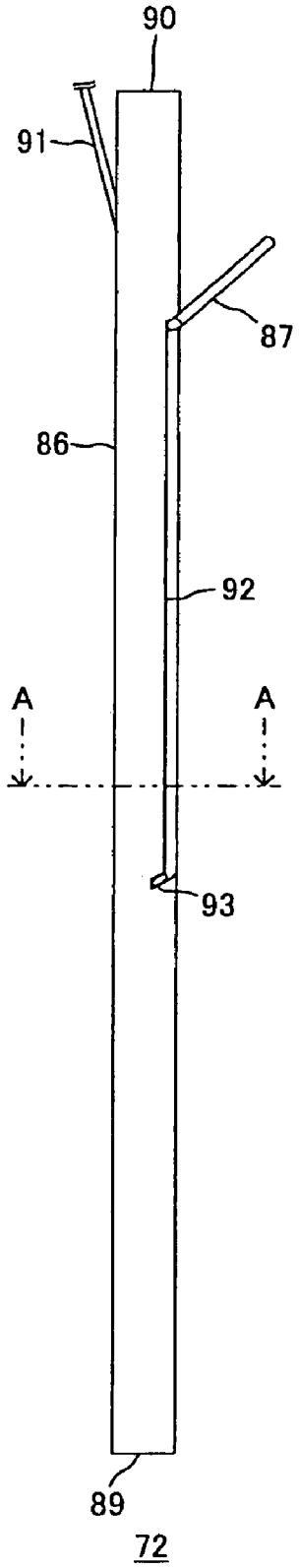
FIG. 5(*a*) is a side view of a suction member of the toner removal device according to the embodiment of the present invention.
Figure 5B:
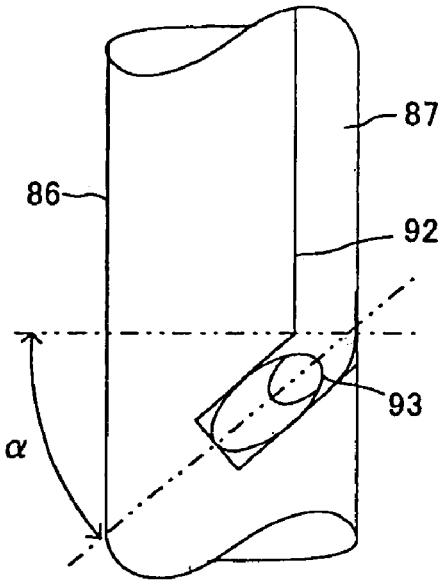
Figure 5C:
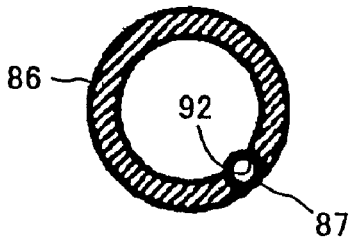
Figure 6:
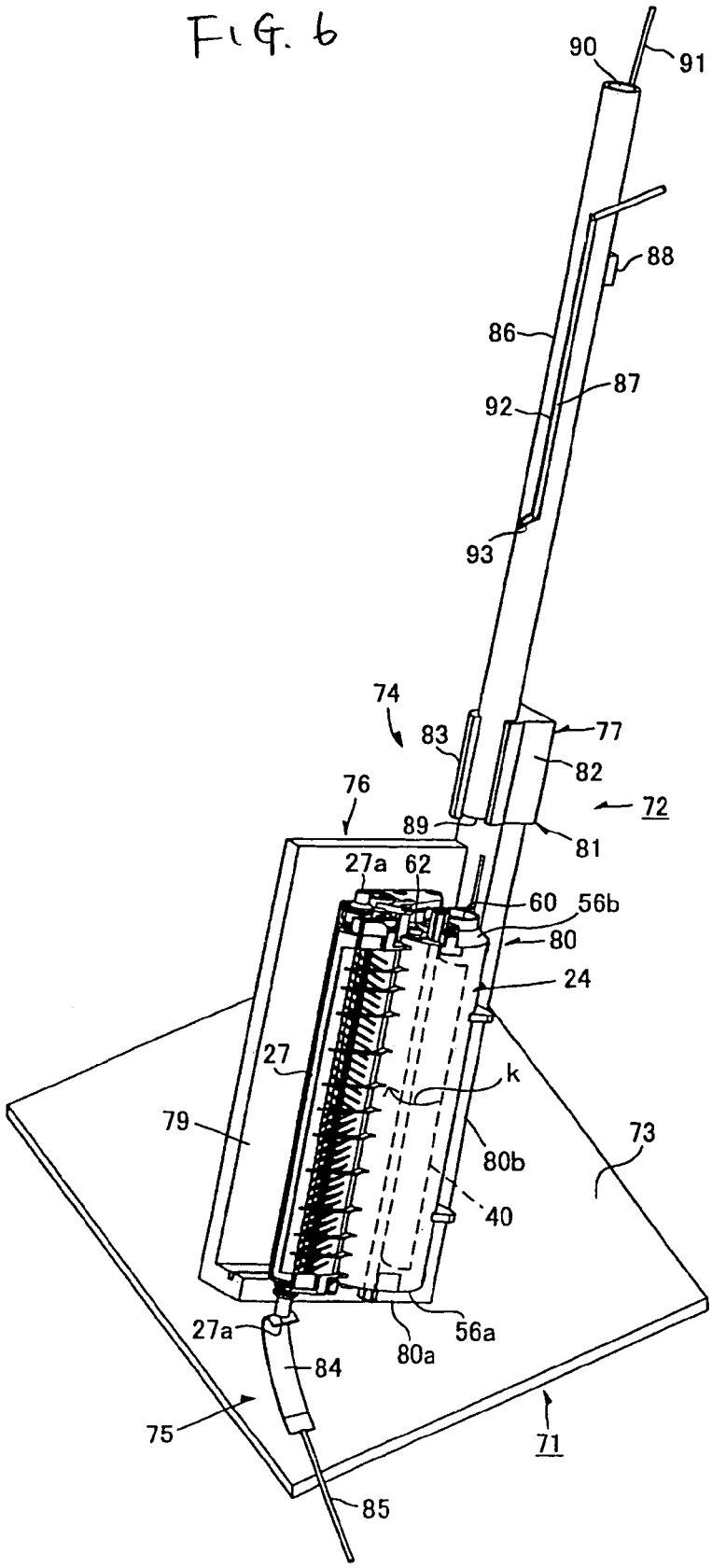
FIG. 6 is a perspective view of the toner removal device to which the developing cartridge is placed.

In this method, a toner removal device 70 shown in FIG. 6 is used. The toner removal device 70 includes a supporting member 71 shown in FIG. 4 and a suction member 72 shown in FIG. 5(*a*).

Figure 4:
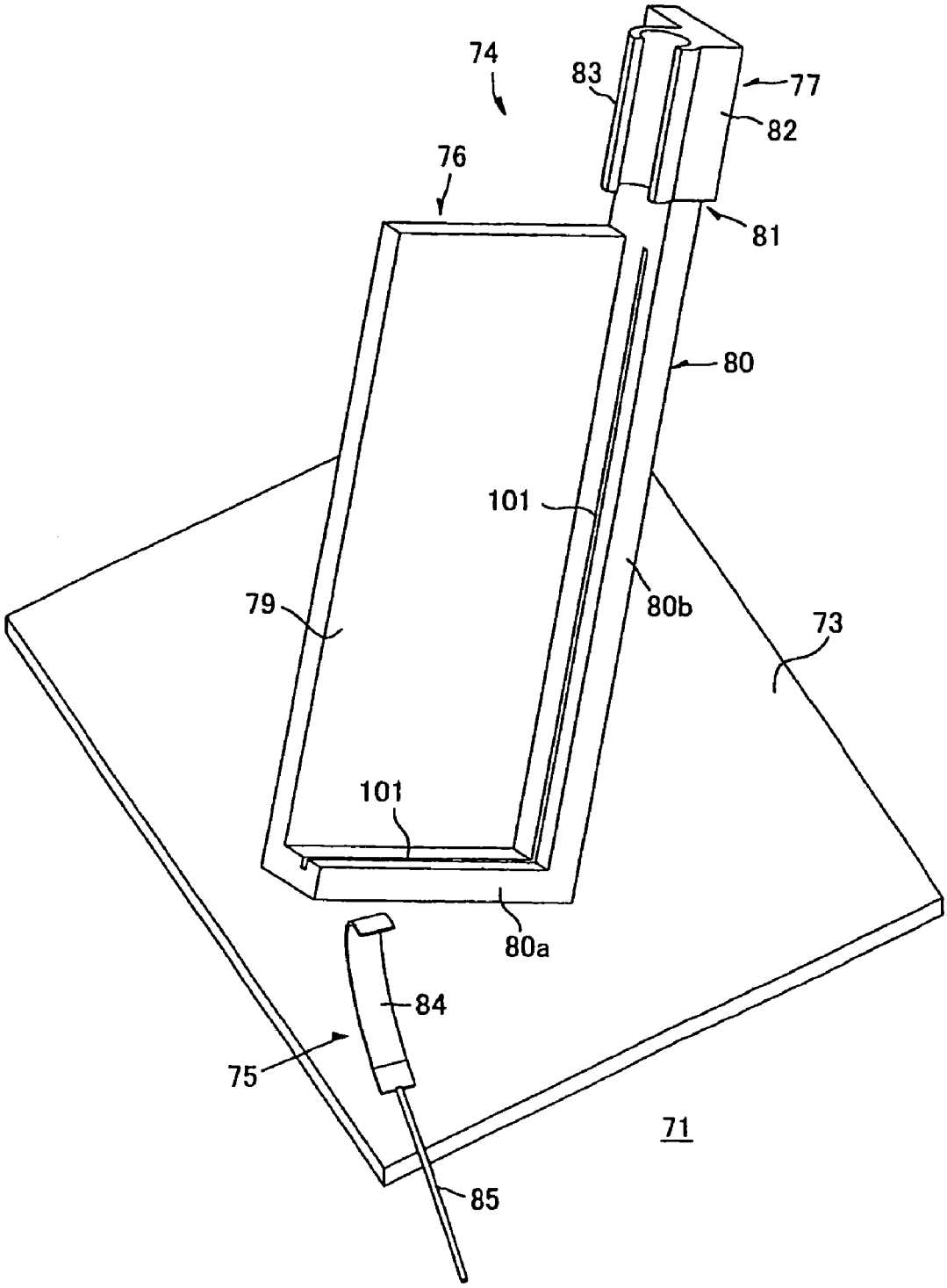
FIG. 4 is a perspective view of a supporting device used in a toner removal device according to the embodiment of the present invention.

As shown in FIG. 4, the supporting member 71 includes a base 73, a support 74, and a grounding member 75. The base 73 has an approximately rectangular plate shape, and the support 74 is set upon the base 73. The support 74 has a supporting section 76 that supports the developing cartridge 24 and a guide section 77 that guides the insertion of the suction member 72 into the developing cartridge 24 supported by the supporting section 76.

The supporting section 76 has a base plate 79 and a side plate 80. The base plate 79 has an approximately rectangular plate shape. The side plate 80 is approximately L-shaped and has a lower plate 80*a* and a side section plate 80*b*. The lower plate 80*a* is provided at a lengthwise end of the base plate 79. The side section plate 80*b* is provided at a side of the base plate 79 in the lateral direction orthogonal to the lengthwise direction and is formed continuous with a lengthwise end of the lower plate 80*a*.

An inner surface of the lower plate 80*a* facing the base plate 79 is formed with the positioning groove 101 extending in the lengthwise direction of the lower plate 80*a*. Similarly, an inner surface of the side section plate 80*b* facing the base plate 79 is formed with the positioning groove 101 extending in the lengthwise direction of the side section plate 80*b*. These positioning grooves 101 are for guiding and positioning the developing cartridge 24 with respect to the support 74 when mounting the developing cartridge 24 to the support 74.

The guide section 77 has an arm 81 continuing and extending from a lengthwise end of the side section plate 80*b*, a mounting section 82 fitted to the arm 81, and a supporting section 83 provided to the mounting section 82.

The mounting section 82 has an angular tube shape that can be fitted over the arm 81. The supporting section 83 is formed integrally over the entire length of the mounting section 82 and has an approximately C-shaped cross-section. The mounting section 82 is inserted into and fixed in the arm 81.

The grounding member 75 has an electrically conductive plate 84 and a conductor wire 85. The electrically conductive plate 84 has an approximately rectangular shape, and the conductor wire 85 extends from one end of the electrically conductive plate 84. The other end of the electrically conductive plate 84 is bent into a curled shape and is positioned in the vicinity of a corner of the upper surface of the base 73, so as to come into contact with the roller shaft 27*a* of the developing roller 27 when the developing cartridge 24 is placed in the supporting section 76. Although not shown in the drawings, the conductor wire 85 is grounded.

As shown in FIG. 8, two approximately rectangular supporting plates 78 of different heights are set upright on the base 73 at a predetermined distance from each other. By joining the base plate 79 of the support 74 to each supporting plate 78, the support 74 is positioned at an incline with respect to the vertical direction and horizontal direction, more specifically at an angle of 40° to 50° with respect to the vertical direction.

As shown in FIG. 5(*a*), the suction member 72 includes a suction tube 86, an injection tube 87, and a positioning member 88 (FIG. 6).

As shown in FIG. 5(*a*), the suction tube 86 has a narrow cylindrical shape formed so as to have the same diameter throughout its length, with a suction aperture 89 at the tip thereof and a discharging aperture 90 at the rear end thereof. A suction apparatus (not shown) is fitted to the discharging aperture 90 for collecting residual toner through the suction tube 86 by sucking up the toner.

The suction tube 86 is formed with an elongated receiving groove 92 extending in the lengthwise direction of the suction tube 86 in its outer surface partway along the length of the suction tube 86 for receiving the injection tube 87. The receiving groove 92 has such width and shape that the outer surface of the injection tube 87 set into the receiving groove 92 and the outer surface of the suction tube 86 are virtually flush. As shown in FIG. 5(*b*), a tip end of the receiving groove 92 is formed so as to incline at a predetermined angle $\alpha$ toward the suction aperture 89 side from the direction orthogonal to the lengthwise direction of the suction tube 86. In this embodiment, the predetermined angle $\alpha$ is set to 30°.

The injection tube 87 is a long, thin, flexible resin tube. As shown in FIG. 5(*a*), the tip of the injection tube 87 functions as an injection aperture 93. An air supply device, such as a compressor, (not shown) is connected to the other end of the injection tube 87 for injecting air into the developing cartridge 24 through the injection tube 87.

As shown in FIG. 5(*c*), the injection tube 87 is set into the receiving groove 92 formed in the suction tube 86 such that the injection aperture 93 of the injection tube 87 faces radially outward of the suction tube 86 and in a direction inclined at the predetermined angle $\alpha$ toward the suction aperture 89 side from the direction orthogonal to the lengthwise direction of the suction tube 86. Accordingly, the injection aperture 93 is fixed so that the direction of air injected from the injection aperture 93 is maintained constant with respect to the direction of suction of the suction aperture 89 (direction from the suction aperture 89 to the discharge aperture 93).

Because the direction of air injected from the injection aperture 93 is maintained constant with respect to the direction of suction of the suction aperture 89, air can always be injected from a fixed direction with respect to the direction of suction of the suction aperture 89 inside the developing cartridge 24 into which the suction tube 86 is inserted. Consequently, toner remaining inside the developing cartridge 24 can be collected in a stable manner.

More specifically, air injected from the injection aperture 93 is injected radially outward of the suction tube 86 and in a direction inclined toward the suction aperture 89 side with respect to the direction orthogonal to the lengthwise direction of the suction tube 86. Thus, air can be prevented from being directly injected in the vicinity of the suction aperture 89 through which toner is sucked up. As a result, toner is collected efficiently in the lowest part of the developing cartridge 24, and thus collected toner can be sucked up thoroughly by the suction apparatus through the suction tube 86.

Because the injection tube 87 is set into the receiving groove 92 formed in the outer surface of the suction tube 86, the injection tube 87 can be secured to the suction tube 86 by a simple configuration. Also, as will be described later, the injection tube 87 can be inserted smoothly into the developing cartridge 24 together with the suction tube 86.

As shown in FIG. 5(*a*), a ground 91 is provided in the vicinity of the discharging aperture 90 of the suction tube 86 in order to ground the suction tube 86. By providing the ground 91, even if the suction tube 86 is subjected to static electricity due to toner suction, the static electricity can be eliminated immediately via the ground 91.

As shown in FIG. 6, the positioning member 88 is formed on the outer surface of the suction tube 86 on the discharging aperture 90 side partway along the lengthwise direction of the suction tube 86 so as to protrude outward from the outer surface of the suction tube 86.

Toner remaining in a used developing cartridge 24 is removed using the toner removal device 70 in the following manner. First, the developing cartridge 24 is placed on the supporting section 76 of the supporting member 71 with the aperture 60 formed in the end wall 56*b* of the developing cartridge 24 facing upward. More specifically, the outer ribs 102 of the casing 24*a* are fitted into the positioning groove 101 of the side section plate 80*b*. Also, an outer rib (not shown) provided on the end wall 56*a* of the developing cartridge 24 is fitted in the positioning groove 101 of the lower plate 80*a*. In this manner, the developing cartridge 24 is supported by the supporting section 76 at a predetermined position and angle. That is, the developing cartridge 24 is placed so as to be inclined with respect to the vertical and horizontal directions. In other words, the axial direction of the developing roller 27 is inclined with respect to the vertical and horizontal directions. More specifically, the lengthwise direction of the developing cartridge 24 and the axial direction of the developing roller 27 are inclined by 40° to 50° with respect to the vertical direction. Also, the roller shaft 27*a* of the developing roller 27 supported by the end wall 56*a* of the casing 24*a* comes into contact with the electrically conductive plate 84 such that the developing roller 27 is grounded.

Next, an agitator drive gear (not shown) is slightly rotated so as to slightly rotate the agitator 40 in a direction indicated by an arrow K in FIG. 6 to a position in which the agitator 40 will not come into contact with the suction tube 86 when the suction tube 86 is inserted to the toner chamber 26*a*. As a result, the suction tube 86 can be inserted into the toner chamber 26*a* without interfering with the agitator 40 provided inside the toner chamber 26*a*. Thus, the suction tube 86 can be smoothly inserted into the toner chamber 26*a*.

Then, the suction apparatus (not shown) is fitted to the discharging aperture 90 of the suction tube 86, and the suction aperture 89 end of the suction tube 86 is inserted into the supporting section 83 of the guide section 77.

Next, the suction tube 86 is inserted into the toner chamber 26*a* of the developing cartridge 24, and toner remaining inside the developing cartridge 24 is sucked up through the suction tube 86.

Figure 7:
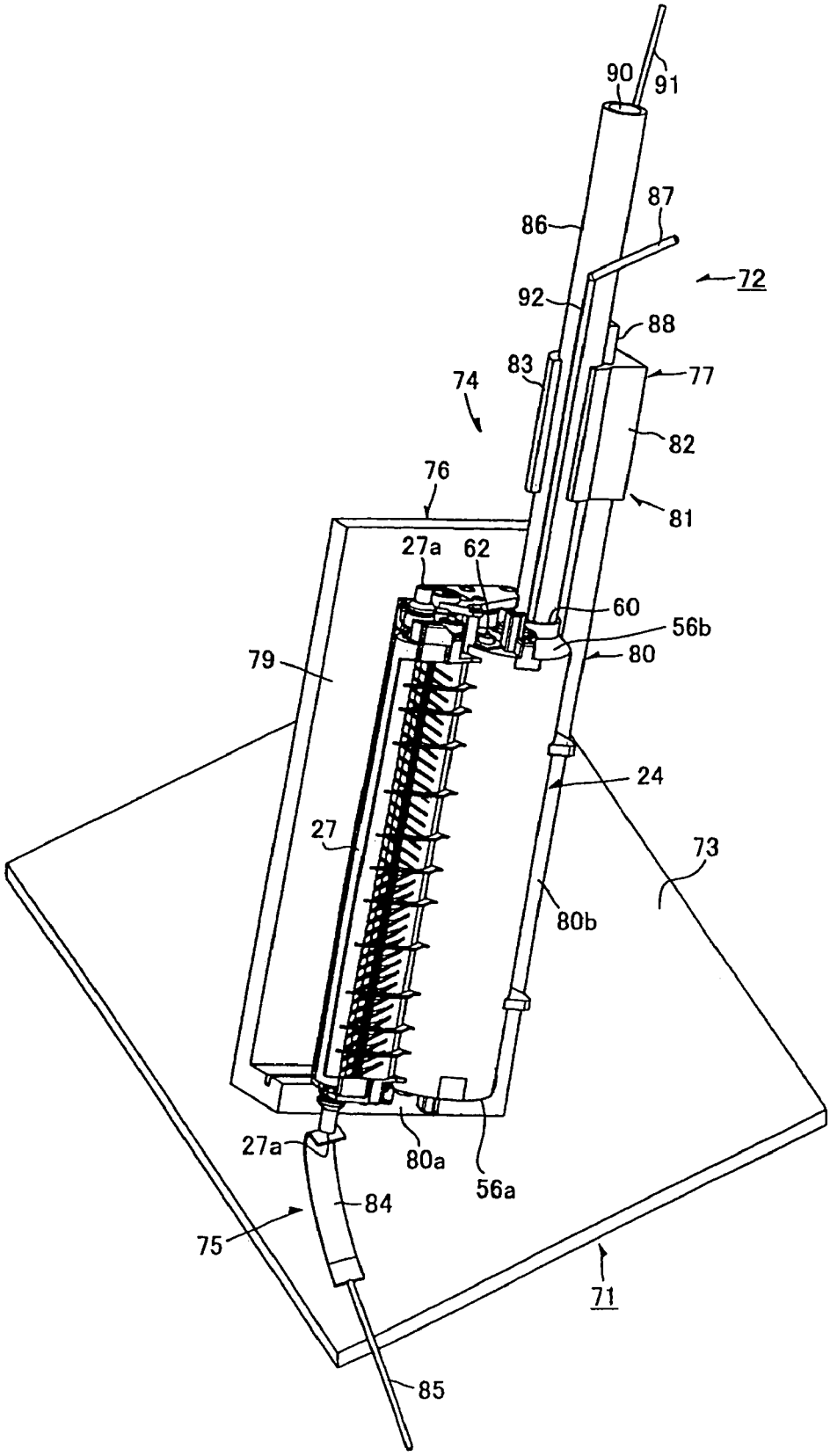
FIG. 7 is a perspective view of the toner removal device with the suction member inserted into the developing device.

More specifically, as shown in FIG. 7, the suction tube 86 is slid downward along the supporting section 83 of the guide section 77 and inserted into the toner chamber 26*a* of the developing cartridge 24 through the aperture 60. At this time, the suction tube 86 can be smoothly inserted into the toner chamber 26*a* because the suction tube 86 is formed to have the same diameter along its length (in the direction of suction). Also, by setting the inner diameter of the aperture 60 of the developing cartridge 24 and the outer diameter of the suction tube 86 to an appropriate size, leakage of toner from the aperture 60 when the suction tube 86 is inserted to or removed from the aperture 60 can be effectively prevented.

When the positioning member 88 of the suction tube 86 comes into contact with the upper surface of the guide section 77, the suction tube 86 cannot be inserted further into the toner chamber 26*a*. In this manner, the depth of insertion of the suction tube 86 into the toner chamber 26*a* is determined.

When the suction tube 86 is positioned by the positioning member 88 in this way, the suction aperture 89 is located inside the toner chamber 26*a* at a position approximately 10 mm, for example, from the inner surface of the end wall 56*a*, so that a space S for sucking up toner is secured between the end wall 56*a* and the suction aperture 89 as shown in FIG. 8. Also, the injection aperture 93 of the injection tube 87 inserted into the toner chamber 26*a* together with the suction tube 86 is placed above the center of the lengthwise direction of the developing cartridge 24, approximately 20 mm, for example, from the inner wall surface of the end wall 56*b*.

Then, toner remaining inside the developing cartridge 24 is sucked up through the suction aperture 89 by driving of the suction apparatus (not shown).

Here, because the depth of insertion of the suction tube 86 can be determined uniformly by the positioning member 88 so that the suction tube 86 is positioned easily and dependably at the optimal insertion depth so as to secure the space S, toner remaining inside the developing cartridge 24 can be sucked up efficiently.

When suction is started, air is supplied at a compression of 49 Pa, for example, from the air supply device (not shown) so that air is injected into the developing cartridge 24 through the injection aperture 93 of the injection tube 87.

Because the supporting member 71 supports the developing cartridge 24 so that the lengthwise directions of the developing cartridge 24 and the developing roller 27 are inclined with respect to the vertical and horizontal directions (inclined at an angle of 40° to 50° with respect to the vertical direction) as described above, toner distributed widely inside the toner chamber 26*a* and developing chamber 26*b* of the developing cartridge 24 can be collected efficiently in the lowest part of thus inclined developing cartridge 24. As a result, toner collected in the lowest part of the developing cartridge 24 can be thoroughly and efficiently removed.

Also, the air injected into the developing cartridge 24 can effectively collect in the lowest part, toner that is unlikely to collect in the lowest part simply as a result of placing the developing cartridge 24 in an inclined position, such as toner that has collected in crevices in the developing cartridge 24.

In particular, because the injection aperture 93 is located above the center of the lengthwise direction inside the developing cartridge 24, injected air blows remaining toner downward. As a result, the remaining toner can be collected efficiently in the lowest part.

Also, at this time, the suction tube 86 is positioned by the positioning member 88 to be immovable with respect to the direction of suction (direction from the suction aperture 89 to the discharging aperture 90), so that suction via the suction aperture 89 is stabilized in the direction of suction. As a result, toner remaining inside the developing cartridge 24 can be reliably removed.

Moreover, if the suction operation is performed with the suction tube 86 moved up and down in the direction of suction with respect to the aperture 60, there is a possibility of toner inside the developing cartridge 24 flying out of the aperture 60 due to this up-and-down movement. However, in this embodiment, suction is performed with the suction tube 86 fixed with respect to the direction of suction, preventing such a problem.

In the suction process, it is desirable to first direct the air injection direction from the injection aperture 93 toward the inner ribs 94 and the supply roller 29 as indicated by arrows X in FIG. 8 and thereafter to rotate the suction tube 86 by 180° about its lengthwise axis as indicated by an arrow Y. By first directing the air injection direction toward the inner ribs 94 and the supply roller 29, toner lodged on the inner ribs 94 and toner adhering to the supply roller 29 is dispersed and can be removed efficiently through the suction tube 86.

Figure 9:
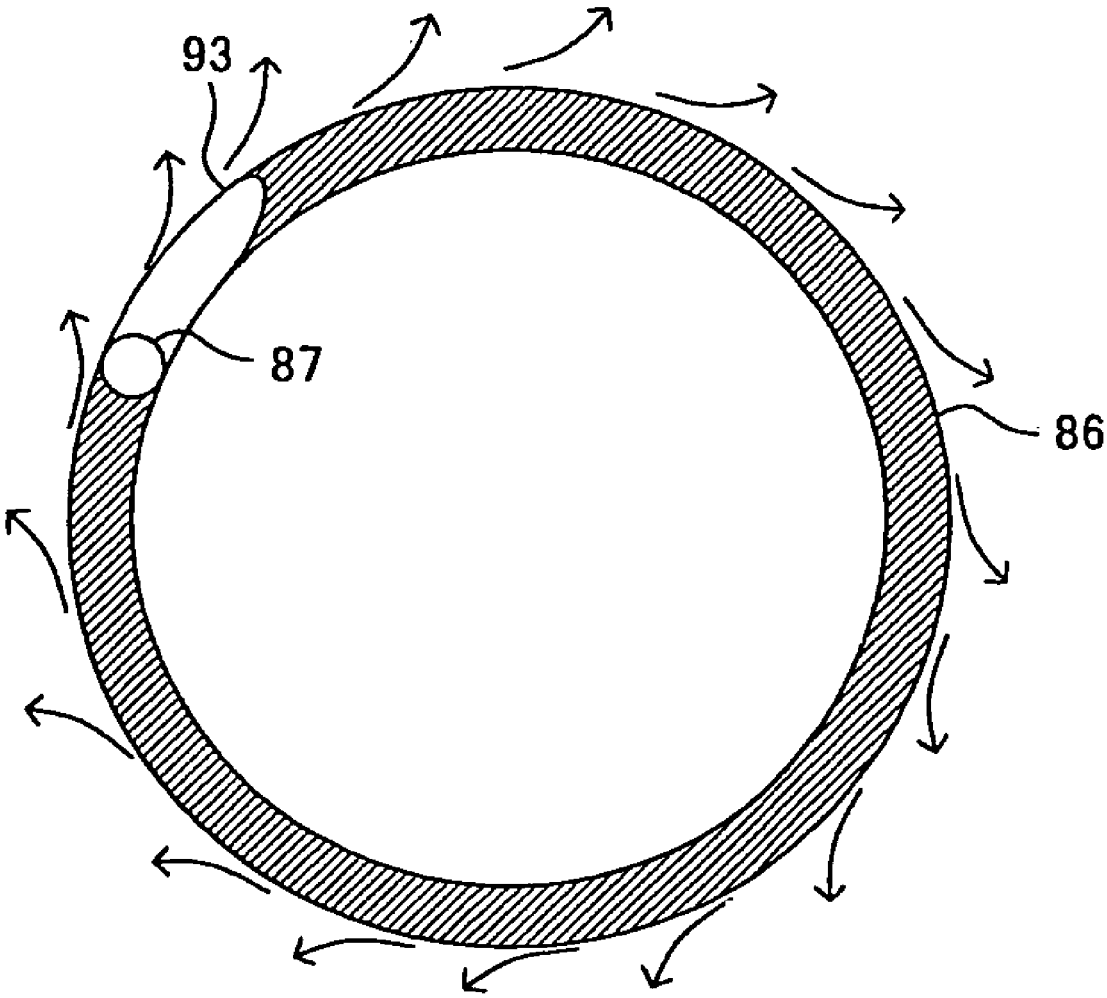
FIG. 9 is a schematic diagram showing air jet directions accompanying rotation of the suction member.

Also, by rotating the suction tube 86 about its lengthwise axis thereafter, the injection tube 87 rotates circumferentially around the suction tube 86, and air can be uniformly injected circumferentially with respect to the lengthwise direction of the suction tube 86 as indicated by arrows in FIG. 9. Thus, toner remaining inside the developing cartridge 24 can be uniformly dispersed, collected efficiently in the lowest part, and removed thoroughly and efficiently. Because the injection aperture 93 is fixed to the injection tube 86, the operator can easily ascertain the air injection direction and inject air in a desirable direction by rotating the suction tube 86.

By removing toner remaining inside the developing cartridge 24 in this way, toner remaining in a used developing cartridge 24 can be removed in approximately 30 seconds to leave approximately 14 g of toner, which does not affect insertion and use of new toner.

When removal of toner is completed, driving of the air supply device is halted to stop the supply of air injected from the injection aperture 93. Also, suction by the suction aperture 89 is stopped by halting driving of the suction apparatus. Then, the suction tube 86 is pulled upward along the supporting section 83 of the guide section 77 and removed.

In this embodiment, the toner contained in the casing 24*a* of the developing cartridge 24 is approximately spherical polymeric toner. Due to its fluidity, toner can be collected smoothly in the lowest part of the developing cartridge 24, and toner can be sucked up smoothly through the suction tube 86.

While an exemplary embodiment of this invention have been described in detail, those skilled in the art will recognize that there are many possible modifications and variations which may be made in this exemplary embodiment while yet retaining many of the novel features and advantages of the invention.

What is claimed is:

1. A developer removal method for removing developer remaining inside a developing device, the developer removal method comprising:

placing the developing device such that a lengthwise direction of the developing device is inclined with respect to a vertical direction and a horizontal direction;

inserting a suction device into the developing device;

sucking the developer remaining in the developing device by the suction device; and rotating an agitator provided inside the developing device so as to avoid contact between the agitator and the suction device inserted into the developing device, the agitator being for agitating developer.

2. The developer removal method according to claim 1, wherein in the placing step, the developing device is placed such that the lengthwise direction of the developing device is inclined by 40° to 50° with respect to the vertical direction.

3. The developer removal method according to claim 1, wherein the suction device includes a suction member formed with a suction aperture for sucking the developer and an injection member formedwith an injection aperture for injecting air, and in the sucking step, air is injected into the developing device by the injection member through the injection aperture.

4. The developer removal method according to claim 3, wherein in the sucking step, the air from the injection aperture is injected toward a supplying device of the developing device, the supplying device being for supplying developer to a developer bearing body of the developing device.

5. The developer removal method according to claim 3, wherein in the sucking step, the air from the injection aperture is injected toward a rib provided inside the developing device, the rib reinforcing the developing device.

6. The developer removal method according to claim 3, wherein in the inserting step, the suction device is inserted into the developing device such that the injection aperture is located above a center in the lengthwise direction of the developing device.

7. The developer removal method according to claim 3, wherein the sucking step includes rotating the suction member about a lengthwise axis of the suction member.

8. The developer removal method according to claim 3, wherein in the sucking step, the suction member is immovable with respect to a suction direction in which the suction device sucks the developer.

9. The developer removal method according to claim 1, wherein the inserting step includes positioning the suction device to a predetermined insertion depth with respect to the developing device using a positioning device of the suction device.

10. The developer removal method according to claim 1, wherein the developer is approximately-spherical toner.

11. A developer removal method for removing developer remaining inside a developing device provided with a developer bearing body, the developer removal method comprising:

placing the developing device such that a lengthwise direction of the developer bearing body is inclined with respect to a vertical direction and a horizontal direction;

inserting a suction device into the developing device;

sucking the developer remaining in the developing device by the suction device; and rotating an agitator provided inside the developing device so as to avoid contact between the agitator and the suction device inserted into the developing device, the agitator being for agitating developer.

12. The developer removal method according to claim 11, wherein in the placing step, the developing device is placed such that the lengthwise direction of the developer bearing body is inclined by 40° to 50° with respect to the vertical direction.

13. The developer removal method according to claim 11, the suction device includes a suction member formed with a suction aperture for sucking the developer and an injection member formed with an injection aperture for injecting air, and in the sucking step, air is injected into the developing device by the injection member through the injection aperture.

14. The developer removal method according to claim 13, wherein in the sucking step, the air from the injection aperture is injected toward a supplying device of the developing device, the supplying device being for supplying developer to the developer bearing body.

15. The developer removal method according to claim 13, wherein in the sucking step, the air from the injection aperture is injected toward a rib provided inside the developing device, the rib reinforcing the developing device.

rotating an agitator provided inside the developing device so as to avoid contact between the agitator and the suction device inserted into the developing device, the agitator being for agitating developer.

16. The developer removal method according to claim 13, wherein in the inserting step, the suction device is inserted into the developing device such that the injection aperture is located above a center in a lengthwise direction of the developing device.

17. The developer removal method according to claim 13, wherein the sucking step includes rotating the suction member about a lengthwise axis of the suction member.

18. The developer removal method according to claim 13, wherein in the sucking step, the suction member is immovable with respect to a suction direction in which the suction device sucks the developer.

19. The developer removal method according to claim 11, wherein the inserting step includes positioning the suction device to a predetermined insertion depth with respect to the developing device using a positioning device of the suction device.

20. The developer removal method according to claim 11, wherein the developer is approximately-spherical toner.

* * * * *